US008069921B2

(12) United States Patent
Garcia et al.

(10) Patent No.: US 8,069,921 B2
(45) Date of Patent: Dec. 6, 2011

(54) ADJUSTABLE FLOW CONTROL DEVICES FOR USE IN HYDROCARBON PRODUCTION

(75) Inventors: Luis A. Garcia, Houston, TX (US); Martin P. Coronado, Cypress, TX (US); Elmer R. Peterson, Porter, TX (US); Sean L. Gaudette, Katy, TX (US); Michael H. Johnson, Katy, TX (US)

(73) Assignee: Baker Hughes Incorporated, Houston, TX (US)

( * ) Notice: Subject to any disclaimer, the term of this patent is extended or adjusted under 35 U.S.C. 154(b) by 374 days.

(21) Appl. No.: 12/417,346

(22) Filed: Apr. 2, 2009

(65) Prior Publication Data

US 2009/0205834 A1 Aug. 20, 2009

Related U.S. Application Data

(63) Continuation-in-part of application No. 11/875,584, filed on Oct. 19, 2007, now Pat. No. 7,918,272.

(51) Int. Cl.
*E21B 43/04* (2006.01)

(52) U.S. Cl. ..... 166/278; 166/51; 166/236

(58) Field of Classification Search ..... 166/278, 166/51, 228, 236

See application file for complete search history.

(56) References Cited

U.S. PATENT DOCUMENTS

| | | | |
|---|---|---|---|
| 1,362,552 | A | 12/1920 | Alexander et al. |
| 1,649,524 | A | 11/1927 | Hammond |
| 1,915,867 | A | 6/1933 | Penick |
| 1,984,741 | A | 12/1934 | Harrington |
| 2,119,563 | A | 3/1937 | Wells |
| 2,089,477 | A | 8/1937 | Halbert |
| 2,214,064 | A | 9/1940 | Niles |
| 2,257,523 | A | 1/1941 | Combs |
| 2,412,841 | A | 12/1946 | Spangler |
| 2,762,437 | A | 1/1955 | Egan et al. |
| 2,810,352 | A | 10/1957 | Tumilson |
| 2,942,668 | A | 11/1957 | Maly et al. |

(Continued)

FOREIGN PATENT DOCUMENTS

| | | |
|---|---|---|
| CN | 1385594 | 12/2002 |

(Continued)

OTHER PUBLICATIONS

Optimization of Commingled Production Using Infinitely Variable Inflow Control Valves; M.M, J. J. Naus, Delft University of Technology (DUT), Shell International Exploration and production (SIEP); J.D. Jansen, DUT and SIEP; SPE Annual Technical Conference and Exhibition, Sep. 26-29 Houston, Texas, 2004, Society of Patent Engineers.

(Continued)

*Primary Examiner* — Daniel P Stephenson

(74) *Attorney, Agent, or Firm* — Mossman, Kumar & Tyler, PC

(57) ABSTRACT

A flow control device may include a body having at least two flow paths configured to convey the fluid. The flow paths may be hydraulically isolated from one another in the body and at least one of the flow paths may be selectively occludable. In certain arrangements, a filtration element may be positioned upstream of one or more of the plurality of in-flow control devices. The flow paths may utilize features such as chamber and openings in order to impose a specified pressure drop on the fluid flowing thereacross.

17 Claims, 5 Drawing Sheets

U.S. PATENT DOCUMENTS

| | | | |
|---|---|---|---|
| 2,814,947 | A | 12/1957 | Stegemeier et al. |
| 2,942,541 | A | 7/1960 | Maly et al. |
| 3,326,291 | A | 6/1967 | Zandmer |
| 3,385,367 | A | 5/1968 | Kollsman |
| 3,419,089 | A | 12/1968 | Venghiattis |
| 3,451,477 | A | 6/1969 | Kelley |
| 3,675,714 | A | 7/1972 | Thompson |
| 3,692,064 | A | 9/1972 | Hohnerlein et al. |
| 3,739,845 | A | 6/1973 | Berry et al. |
| 3,741,301 | A | 6/1973 | Maly et al. |
| 3,791,444 | A | 2/1974 | Hickey |
| 3,876,471 | A | 4/1975 | Jones |
| 3,918,523 | A | 11/1975 | Stuber |
| 3,951,338 | A | 4/1976 | Genna |
| 3,975,651 | A | 8/1976 | Griffiths |
| 3,987,854 | A | 10/1976 | Callihan et al. |
| 4,153,757 | A | 5/1979 | Clark, III |
| 4,173,255 | A | 11/1979 | Kramer |
| 4,180,132 | A | 12/1979 | Young |
| 4,186,100 | A | 1/1980 | Mott |
| 4,187,909 | A | 2/1980 | Erbstoesser |
| 4,248,302 | A | 2/1981 | Churchman |
| 4,250,907 | A | 2/1981 | Struckman et al. |
| 4,257,650 | A | 3/1981 | Allen |
| 4,287,952 | A | 9/1981 | Erbstoesser |
| 4,294,313 | A | 10/1981 | Schwegman |
| 4,434,849 | A | 3/1984 | Allen |
| 4,491,186 | A | 1/1985 | Alder |
| 4,497,714 | A | 2/1985 | Harris |
| 4,552,218 | A | 11/1985 | Ross et al. |
| 4,572,295 | A | 2/1986 | Walley |
| 4,614,303 | A | 9/1986 | Moseley, Jr. et al. |
| 4,649,996 | A | 3/1987 | Kojicic |
| 4,782,896 | A | 11/1988 | Witten |
| 4,821,800 | A | 4/1989 | Scott et al. |
| 4,856,590 | A | 8/1989 | Caillier |
| 4,917,183 | A | 4/1990 | Gaidry et al. |
| 4,944,349 | A | 7/1990 | Von Gonten, Jr. |
| 4,974,674 | A | 12/1990 | Wells |
| 4,998,585 | A | 3/1991 | Newcomer et al. |
| 5,004,049 | A | 4/1991 | Arterbury |
| 5,016,710 | A | 5/1991 | Renard et al. |
| 5,033,551 | A | 7/1991 | Grantom |
| 5,132,903 | A | 7/1992 | Sinclair |
| 5,156,811 | A | 10/1992 | White |
| 5,333,684 | A | 8/1994 | Walter et al. |
| 5,337,821 | A | 8/1994 | Peterson |
| 5,339,895 | A | 8/1994 | Arterbury et al. |
| 5,377,750 | A | 1/1995 | Arterbury et al. |
| 5,381,864 | A | 1/1995 | Nguyen et al. |
| 5,431,346 | A | 7/1995 | Sinaisky |
| 5,435,393 | A | 7/1995 | Brekke et al. |
| 5,435,395 | A | 7/1995 | Connell |
| 5,439,966 | A | 8/1995 | Graham et al. |
| 5,551,513 | A | 9/1996 | Surles et al. |
| 5,586,213 | A | 12/1996 | Bridges |
| 5,597,042 | A | 1/1997 | Tubel et al. |
| 5,609,204 | A | 3/1997 | Rebardi et al. |
| 5,673,751 | A | 10/1997 | Head et al. |
| 5,803,179 | A | 9/1998 | Echols et al. |
| 5,829,522 | A | 11/1998 | Ross et al. |
| 5,831,156 | A | 11/1998 | Mullins |
| 5,839,508 | A | 11/1998 | Tubel et al. |
| 5,865,254 | A | 2/1999 | Huber et al. |
| 5,873,410 | A | 2/1999 | Iato et al. |
| 5,881,809 | A | 3/1999 | Gillespie et al. |
| 5,896,928 | A | 4/1999 | Coon |
| 5,982,801 | A | 11/1999 | Deak |
| 6,065,535 | A | 5/2000 | Ross |
| 6,068,015 | A | 5/2000 | Pringle |
| 6,098,020 | A | 8/2000 | Den Boer |
| 6,109,350 | A | 8/2000 | Nguyen et al. |
| 6,112,815 | A | 9/2000 | Boe |
| 6,112,817 | A | 9/2000 | Voll et al. |
| 6,119,780 | A | 9/2000 | Christmas |
| 6,228,812 | B1 | 5/2001 | Dawson et al. |
| 6,253,847 | B1 | 7/2001 | Stephenson |
| 6,253,861 | B1 | 7/2001 | Charmichael et al. |
| 6,273,194 | B1 | 8/2001 | Hiron et al. |
| 6,305,470 | B1 | 10/2001 | Woie |
| 6,338,363 | B1 | 1/2002 | Chen et al. |
| 6,367,547 | B1 | 4/2002 | Towers |
| 6,371,210 | B1 | 4/2002 | Bode et al. |
| 6,372,678 | B1 | 4/2002 | Youngman et al. |
| 6,419,021 | B1 | 7/2002 | George et al. |
| 6,474,413 | B1 | 11/2002 | Barbosa et al. |
| 6,505,682 | B2 | 1/2003 | Brockman |
| 6,516,888 | B1 | 2/2003 | Gunnarson et al. |
| 6,581,682 | B1 | 6/2003 | Parent et al. |
| 6,622,794 | B2 | 9/2003 | Zisk, Jr. |
| 6,632,527 | B1 | 10/2003 | McDaniel et al. |
| 6,635,732 | B2 | 10/2003 | Mentak |
| 6,667,029 | B2 | 12/2003 | Zhong et al. |
| 6,672,385 | B2 | 1/2004 | Kilaas et al. |
| 6,679,324 | B2 | 1/2004 | Den Boer et al. |
| 6,692,766 | B1 | 2/2004 | Rubinstein et al. |
| 6,699,503 | B1 | 3/2004 | Sako et al. |
| 6,699,611 | B2 | 3/2004 | Kim et al. |
| 6,786,285 | B2 | 9/2004 | Johnson et al. |
| 6,817,416 | B2 | 11/2004 | Wilson et al. |
| 6,840,321 | B2 | 1/2005 | Restarick et al. |
| 6,857,476 | B2 | 2/2005 | Richards |
| 6,863,126 | B2 | 3/2005 | McGlothen et al. |
| 6,938,698 | B2 | 9/2005 | Coronado |
| 6,951,252 | B2 | 10/2005 | Restarick et al. |
| 6,976,542 | B2 | 12/2005 | Henriksen et al. |
| 7,004,248 | B2 | 2/2006 | Hoffman et al. |
| 7,011,076 | B1 | 3/2006 | Weldon et al. |
| 7,084,094 | B2 | 8/2006 | Gunn et al. |
| 7,128,151 | B2 | 10/2006 | Corbett |
| 7,159,656 | B2 | 1/2007 | Eoff et al. |
| 7,185,706 | B2 | 3/2007 | Freyer |
| 7,290,606 | B2 | 11/2007 | Coronado et al. |
| 7,318,472 | B2 | 1/2008 | Smith |
| 7,322,412 | B2 | 1/2008 | Badalamenti et al. |
| 7,325,616 | B2 | 2/2008 | Lopez de Cardenas |
| 7,395,858 | B2 | 7/2008 | Barbosa et al. |
| 7,409,999 | B2 | 8/2008 | Henriksen et al. |
| 7,413,022 | B2 | 8/2008 | Broome et al. |
| 7,419,002 | B2 | 9/2008 | Dybevik et al. |
| 7,426,962 | B2 * | 9/2008 | Moen et al. ..... 166/306 |
| 7,469,743 | B2 | 12/2008 | Richards |
| 7,493,947 | B2 | 2/2009 | Ross |
| 7,673,678 | B2 | 3/2010 | MacDougall et al. |
| 7,762,341 | B2 | 7/2010 | Hammer |
| 7,896,082 | B2 | 3/2011 | Lake et al. |
| 7,913,765 | B2 | 3/2011 | Crow et al. |
| 7,942,206 | B2 | 5/2011 | Huang et al. |
| 2002/0020527 | A1 | 2/2002 | Kilaas et al. |
| 2002/0125009 | A1 | 9/2002 | Wetzel et al. |
| 2003/0221834 | A1 | 12/2003 | Hess et al. |
| 2004/0035578 | A1 | 2/2004 | Ross et al. |
| 2004/0052689 | A1 | 3/2004 | Yao |
| 2004/0108107 | A1 * | 6/2004 | Wittrisch ..... 166/227 |
| 2004/0144544 | A1 | 7/2004 | Freyer |
| 2004/0194971 | A1 | 10/2004 | Thomson |
| 2005/0016732 | A1 | 1/2005 | Brannon et al. |
| 2005/0126776 | A1 | 6/2005 | Russell |
| 2005/0171248 | A1 | 8/2005 | Li et al. |
| 2005/0178705 | A1 | 8/2005 | Broyles et al. |
| 2005/0189119 | A1 | 9/2005 | Gynz-Rekowski |
| 2005/0199298 | A1 | 9/2005 | Farrington |
| 2005/0207279 | A1 | 9/2005 | Chemali et al. |
| 2005/0241835 | A1 | 11/2005 | Burris et al. |
| 2006/0042798 | A1 | 3/2006 | Badalamenti et al. |
| 2006/0048936 | A1 | 3/2006 | Fripp et al. |
| 2006/0048942 | A1 | 3/2006 | Moen et al. |
| 2006/0076150 | A1 | 4/2006 | Coronado et al. |
| 2006/0086498 | A1 | 4/2006 | Wetzel et al. |
| 2006/0108114 | A1 | 5/2006 | Johnson |
| 2006/0113089 | A1 | 6/2006 | Henriksen et al. |
| 2006/0118296 | A1 * | 6/2006 | Dybevik et al. ..... 166/242.1 |
| 2006/0175065 | A1 | 8/2006 | Ross |
| 2006/0180320 | A1 | 8/2006 | Hilsman et al. |
| 2006/0185849 | A1 | 8/2006 | Edwards et al. |
| 2006/0266524 | A1 | 11/2006 | Dybevik |
| 2006/0272814 | A1 | 12/2006 | Broome et al. |

| | | | |
|---|---|---|---|
| 2006/0273876 | A1 | 12/2006 | Pachla et al. |
| 2007/0012439 | A1 | 1/2007 | McGuire et al. |
| 2007/0012444 | A1 | 1/2007 | Horgan et al. |
| 2007/0034385 | A1 | 2/2007 | Tips et al. |
| 2007/0039732 | A1 | 2/2007 | Dawson et al. |
| 2007/0039741 | A1 | 2/2007 | Hailey, Jr. |
| 2007/0044962 | A1 | 3/2007 | Tibbles |
| 2007/0131434 | A1 | 6/2007 | MacDougall et al. |
| 2007/0246210 | A1 | 10/2007 | Richards |
| 2007/0246213 | A1 | 10/2007 | Hailey, Jr. |
| 2007/0246225 | A1 | 10/2007 | Hailey et al. |
| 2007/0246407 | A1 | 10/2007 | Richards et al. |
| 2007/0272408 | A1 | 11/2007 | Zazovsky et al. |
| 2008/0035349 | A1 | 2/2008 | Richard |
| 2008/0035350 | A1 | 2/2008 | Henriksen |
| 2008/0053662 | A1 | 3/2008 | Williamson et al. |
| 2008/0061510 | A1 | 3/2008 | Li et al. |
| 2008/0110614 | A1 | 5/2008 | Orban |
| 2008/0135249 | A1 | 6/2008 | Fripp et al. |
| 2008/0149323 | A1 | 6/2008 | O'Malley et al. |
| 2008/0149351 | A1 | 6/2008 | Marya et al. |
| 2008/0236839 | A1 | 10/2008 | Oddie |
| 2008/0236843 | A1 | 10/2008 | Scott et al. |
| 2008/0283238 | A1 | 11/2008 | Richards et al. |
| 2008/0296023 | A1 | 12/2008 | Willauer |
| 2008/0314590 | A1 | 12/2008 | Patel |
| 2009/0056816 | A1 | 3/2009 | Arov et al. |
| 2009/0101355 | A1 | 4/2009 | Peterson et al. |
| 2009/0133869 | A1 | 5/2009 | Clem |
| 2009/0133874 | A1 | 5/2009 | Dale et al. |
| 2009/0139727 | A1 | 6/2009 | Tanju et al. |
| 2009/0205834 | A1 | 8/2009 | Garcia et al. |
| 2009/0283275 | A1 | 11/2009 | Hammer |
| 2010/0038086 | A1 | 2/2010 | Bunnell et al. |
| 2010/0096140 | A1 | 4/2010 | Mack |

FOREIGN PATENT DOCUMENTS

| | | | |
|---|---|---|---|
| GB | 1492345 | | 11/1977 |
| GB | 2341405 | | 12/2007 |
| GB | 2421527 | A | 6/2008 |
| GB | 2448069 | A | 10/2008 |
| JP | 59089383 | | 6/1984 |
| SU | 1335677 | A | 9/1987 |
| WO | WO 94/03743 | | 2/1994 |
| WO | WO 00/79097 | | 5/2000 |
| WO | WO 01/65063 | | 2/2001 |
| WO | WO 01/77485 | | 3/2001 |
| WO | WO02/075110 | | 9/2002 |
| WO | WO2004/018833 | A1 | 3/2004 |
| WO | WO2006/015277 | | 7/2005 |
| WO | WO 2008070674 | A1 | 6/2008 |

OTHER PUBLICATIONS

An Oil Selective Inflow Control System; Rune Freyer, Easy Well Solutions; Morten Fejerskkov, Norsk Hydro; Arve Huse, Altinex; European Petroleum Conference, Oct. 29-31, Aberdeen, United Kingdom, Copyright 2002, Society of Petroleum Engineers, Inc.

Determination of Perforation Schemes to Control Production and Injection Profiles Along Horizontal; Asheim, Harald, Norwegian Institute of Technology; Oudeman, Pier, Koninklijke/Shell Exploratie en Producktie Laboratorium; SPE Drilling & Completion, vol. 12, No. 1, March; pp. 13-18; 1997 Society of Petroleum Engineers.

Rapid Swelling and Deswelling of Thermoreversible Hydrophobically Modified Poly (N-Isopropylacrylamide) Hydrogels Prepared by Freezing Polymerization.

Thermoreversible Swelling Behavior of Hydrogels fBased on N-isopropylacrylamide with a Zwitterionic Comonomer.

The Use of Thermoresponsive Hydrogels for On-Off Release of Molecules.

Collapse of Gels in an Electric Field.

Photoinduced Swelling Control of Amphiphallic Azoaromatic Polymer Membrane.

Swelling of Ionic Gels: Quatitative Performance of the Donnan Thory.

SPE 29831 Horizontal Completion Options in Reservoirs with Sand Problems.

Pressure Drop in Horizontal Well and its Effect on Production Performance.

SPE82240 Sand Management: A Review of Approaches and Concerns.

SPE4771 A One-Trip Gravel Packing System.

* cited by examiner

ADJUSTABLE FLOW CONTROL DEVICES FOR USE IN HYDROCARBON PRODUCTION

CROSS-REFERENCE TO RELATED APPLICATION

This application is a continuation-in-part of U.S. patent application Ser. No. 11/875,584 filed on Oct. 19, 2007.

BACKGROUND OF THE DISCLOSURE

1. Field of the Disclosure

The disclosure relates generally to systems and methods for selective control of fluid flow between a wellbore tubular such as a production string and a subterranean formation.

2. Description of the Related Art

Hydrocarbons such as oil and gas are recovered from a subterranean formation using a wellbore drilled into the formation. Such wells are typically completed by placing a casing along the wellbore length and perforating the casing adjacent each such production zone to extract the formation fluids (such as hydrocarbons) into the wellbore. These production zones are sometimes separated from each other by installing a packer between the production zones. Fluid from each production zone entering the wellbore is drawn into a tubing that runs to the surface. It is desirable to have substantially even drainage along the production zone. Uneven drainage may result in undesirable conditions such as an invasive gas cone or water cone. In the instance of an oil-producing well, for example, a gas cone may cause an in-flow of gas into the wellbore that could significantly reduce oil production. In like fashion, a water cone may cause an in-flow of water into the oil production flow that reduces the amount and quality of the produced oil. Accordingly, it may be desired to provide controlled drainage across a production zone and/or the ability to selectively close off or reduce in-flow within production zones experiencing an undesirable influx of water and/or gas. Additionally, it may be desired to inject a fluid into the formation using the wellbore tubular.

The present disclosure addresses these and other needs of the prior art.

SUMMARY OF THE DISCLOSURE

In aspects, the present disclosure provides an apparatus for controlling a flow of a fluid between a wellbore tubular and a formation. The apparatus may include a body having at least two flow paths configured to convey the fluid. The flow paths may be hydraulically isolated from one another in the body, and at least one of the flow paths may be occludable. In some arrangements, each of the at least two flow paths generates a different pressure drop in the fluid flowing there across. In certain embodiments, at least one of the flow paths includes a chamber and at least one opening communicating with the chamber. Other embodiments may include more than one chamber and openings. For instance, a flow path may include a plurality of chambers, each of the chambers being in fluid communication with one another. In arrangements, each of the several flow paths includes a plurality of chambers and each of the chambers may be in fluid communication with one another. Each of the flow paths may generate a different pressure drop there across. In certain embodiments, each of the flow paths has a first end in communication with an annulus of the wellbore and a second end in communication with a bore of the wellbore tubular. Also, in arrangements, an occlusion member may occlude one or more of the flow paths.

In aspects, the present disclosure provides a method for controlling a flow of a fluid between a wellbore tubular and an annulus of the well. The method may include forming at least two flow paths in a body, each of the flow paths having a first end in communication with the annulus and a second end in communication with a bore of the wellbore tubular; forming at least one of the at least two flow paths to receive an occlusion member; and hydraulically isolating the at least two flow paths from one another in the body. The method may further include occluding at least one of the flow paths with the occlusion member. In embodiments, the method may also include configuring each of the flow paths to generate a different pressure drop in the fluid flowing there across. Also, the method may include configuring at least one of the flow paths to include a chamber and at least one opening communicating with the chamber. Further, the method may include configuring at least one of the flow paths to include a plurality of chambers, each of the chambers being in fluid communication with one another. Still further, the method may include configuring each of the at least two flow paths to include a plurality of chambers, each of the chambers being in fluid communication with one another, and wherein each of the at least two flow paths generates a different pressure drop there across. Also, the method may include providing each of the at least two flow paths with a first end in communication with an annulus of the wellbore and a second end in communication with a bore of the wellbore tubular.

In still further aspects, the present disclosure provides a system for controlling a flow of fluid in a well. The system may include a wellbore tubular disposed in the well, the wellbore tubular having a flow bore and; a plurality of flow control devices positioned along the wellbore tubular. Each of the flow control devices may include a body having a plurality of flow paths configured to convey the fluid between an annulus of the well and the flow bore, each of the flow paths having a first end in communication with an annulus of a wellbore and a second end in communication with the flow bore and each of the flow paths being hydraulically isolated from one another between their respective first ends and second ends, and wherein at least one of the plurality of flow paths is selectively closable.

It should be understood that examples of the more important features of the disclosure have been summarized rather broadly in order that detailed description thereof that follows may be better understood, and in order that the contributions to the art may be appreciated. There are, of course, additional features of the disclosure that will be described hereinafter and which will form the subject of the claims appended hereto.

BRIEF DESCRIPTION OF THE DRAWINGS

The advantages and further aspects of the disclosure will be readily appreciated by those of ordinary skill in the art as the same becomes better understood by reference to the following detailed description when considered in conjunction with the accompanying drawings in which like reference characters designate like or similar elements throughout the several figures of the drawing and wherein.

DETAILED DESCRIPTION OF THE DISCLOSURE

Figure 1:
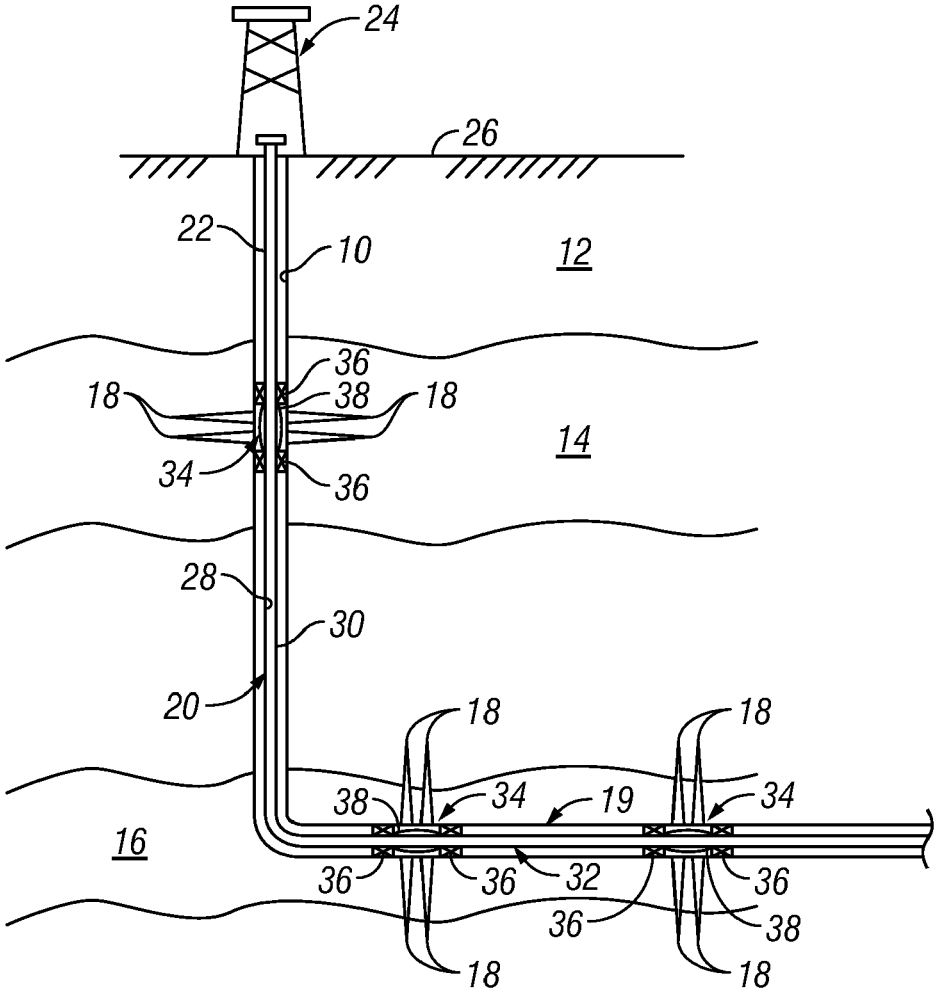
FIG. 1 is a schematic elevation view of an exemplary multi-zonal wellbore and production assembly which incorporates an in-flow control system in accordance with one embodiment of the present disclosure.

The present disclosure relates to devices and methods for controlling a flow of fluid in a well. The present disclosure is susceptible to embodiments of different forms. There are shown in the drawings, and herein will be described in detail, specific embodiments of the present disclosure with the understanding that the present disclosure is to be considered an exemplification of the principles of the disclosure and is not intended to limit the disclosure to that illustrated and described herein.

Referring initially to FIG. 1, there is shown an exemplary wellbore 10 that has been drilled through the earth 12 and into a pair of formations 14, 16 from which it is desired to produce hydrocarbons. The wellbore 10 is cased by metal casing, as is known in the art, and a number of perforations 18 penetrate and extend into the formations 14, 16 so that production fluids may flow from the formations 14, 16 into the wellbore 10. The wellbore 10 has a deviated, or substantially horizontal leg 19. The wellbore 10 has a late-stage production assembly, generally indicated at 20, disposed therein by a tubing string 22 that extends downwardly from a wellhead 24 at the surface 26 of the wellbore 10. The production assembly 20 defines an internal axial flowbore 28 along its length. An annulus 30 is defined between the production assembly 20 and the wellbore casing. The production assembly 20 has a deviated, generally horizontal portion 32 that extends along the deviated leg 19 of the wellbore 10. Production devices 34 are positioned at selected points along the production assembly 20. Optionally, each production device 34 is isolated within the wellbore 10 by a pair of packer devices 36. Although only two production devices 34 are shown in FIG. 1, there may, in fact, be a large number of such production devices arranged in serial fashion along the horizontal portion 32.

Each production device 34 features a production control device 38 that is used to govern one or more aspects of a flow of one or more fluids into the production assembly 20. As used herein, the term "fluid" or "fluids" includes liquids, gases, hydrocarbons, multi-phase fluids, mixtures of two of more fluids, water, brine, engineered fluids such as drilling mud, fluids injected from the surface such as water, and naturally occurring fluids such as oil and gas. Additionally, references to water should be construed to also include water-based fluids; e.g., brine or salt water. In accordance with embodiments of the present disclosure, the production control device 38 may have a number of alternative constructions that ensure selective operation and controlled fluid flow therethrough.

Figure 2:
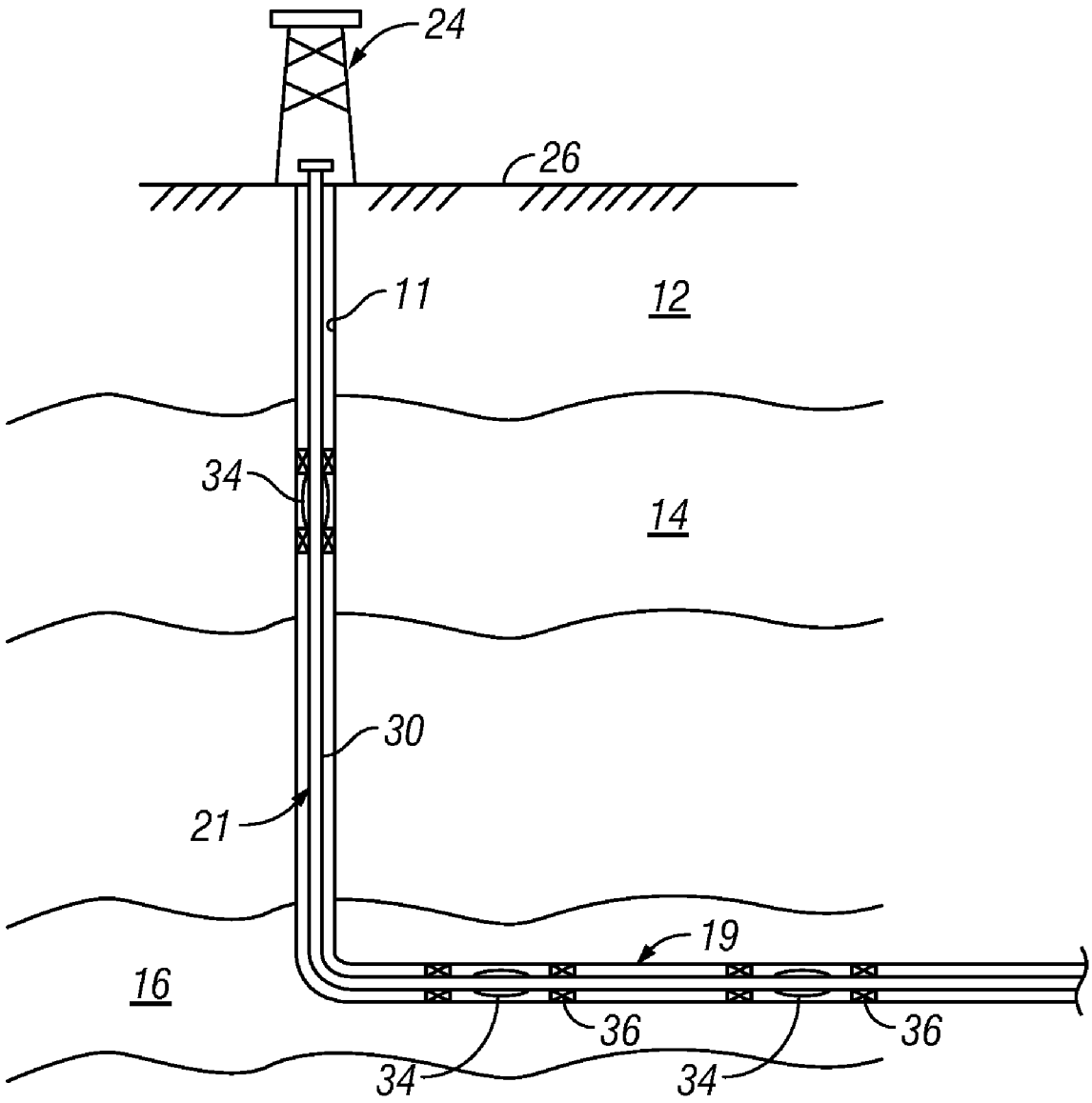
FIG. 2 is a schematic elevation view of an exemplary open hole production assembly which incorporates an in-flow control system in accordance with one embodiment of the present disclosure.

FIG. 2 illustrates an exemplary open hole wellbore arrangement 11 wherein the production devices of the present disclosure may be used. Construction and operation of the open hole wellbore 11 is similar in most respects to the wellbore 10 described previously. However, the wellbore arrangement 11 has an uncased borehole that is directly open to the formations 14, 16. Production fluids, therefore, flow directly from the formations 14, 16, and into the annulus 30 that is defined between the production assembly 21 and the wall of the wellbore 11. There are no perforations, and open hole packers 36 may be used to isolate the production control devices 38. The nature of the production control device is such that the fluid flow is directed from the formation 16 directly to the nearest production device 34, hence resulting in a balanced flow. In some instances, packers maybe omitted from the open hole completion.

Figure 3:
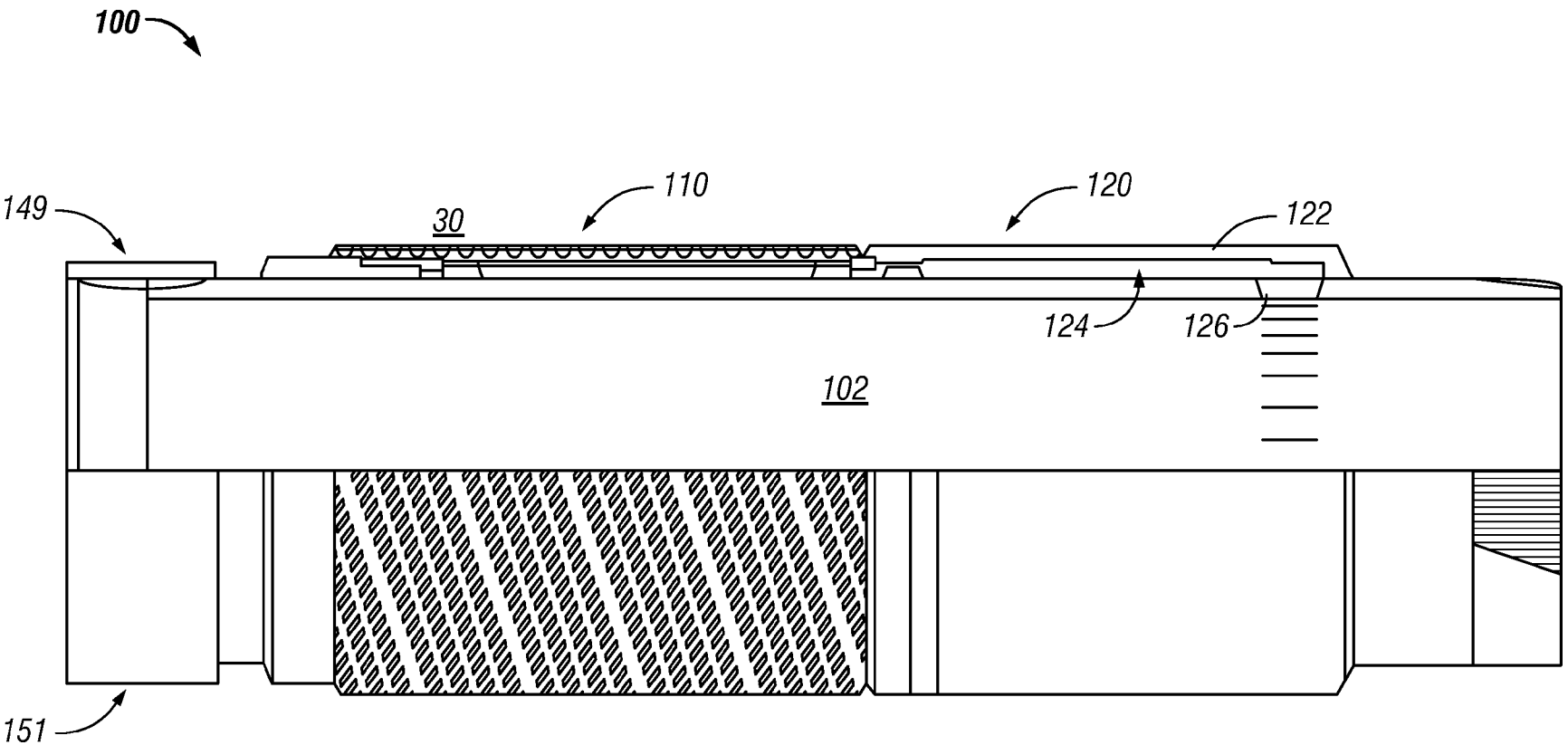
FIG. 3 is a schematic cross-sectional view of an exemplary production control device made in accordance with one embodiment of the present disclosure.

Referring now to FIG. 3, there is shown one embodiment of a production control device 100 for controlling the flow of fluids from a reservoir into a production string, or "in-flow" and/or the control of flow from the production string into the reservoir, our "out-flow." This flow control may be a function of one or more characteristics or parameters of the formation fluid, including water content, fluid velocity, gas content, etc. Furthermore, the control devices 100 can be distributed along a section of a production well to provide fluid control at multiple locations. Exemplary production control devices are discussed herein below.

In one embodiment, the production control device 100 includes a particulate control device 110 for reducing the amount and size of particulates entrained in the fluids and a flow control device 120 that controls overall drainage rate from the formation. The particulate control device 110 can include known devices such as sand screens and associated gravel packs.

In embodiments, the flow control device 120 utilizes a plurality of flow paths or channels to create a predetermined pressure drop that assists in controlling a flow rate and/or an out-flow rate. One or more of these flow paths may be occluded in order to provide the specified pressure drop. An exemplary flow control device 120 creates a pressure drop for controlling flow by channeling the flowing fluid through one or more conduits 122. Each conduit may be configured to provide an independent flow path between the flow bore 102 of the tubular 22 and the annular space or annulus 30 separating the device 120 from the formation. Additionally, some or all of these conduits 122 may be substantially hydraulically isolated from one another. That is, the flow across the conduits 122 may be considered parallel rather than in series. Thus, the flow across one conduit 122 may be partially or totally blocked without substantially affecting the flow across another conduit. It should be understood that the term "parallel" is used in the functional sense rather than to suggest a particular structure or physical configuration.

Figure 4:
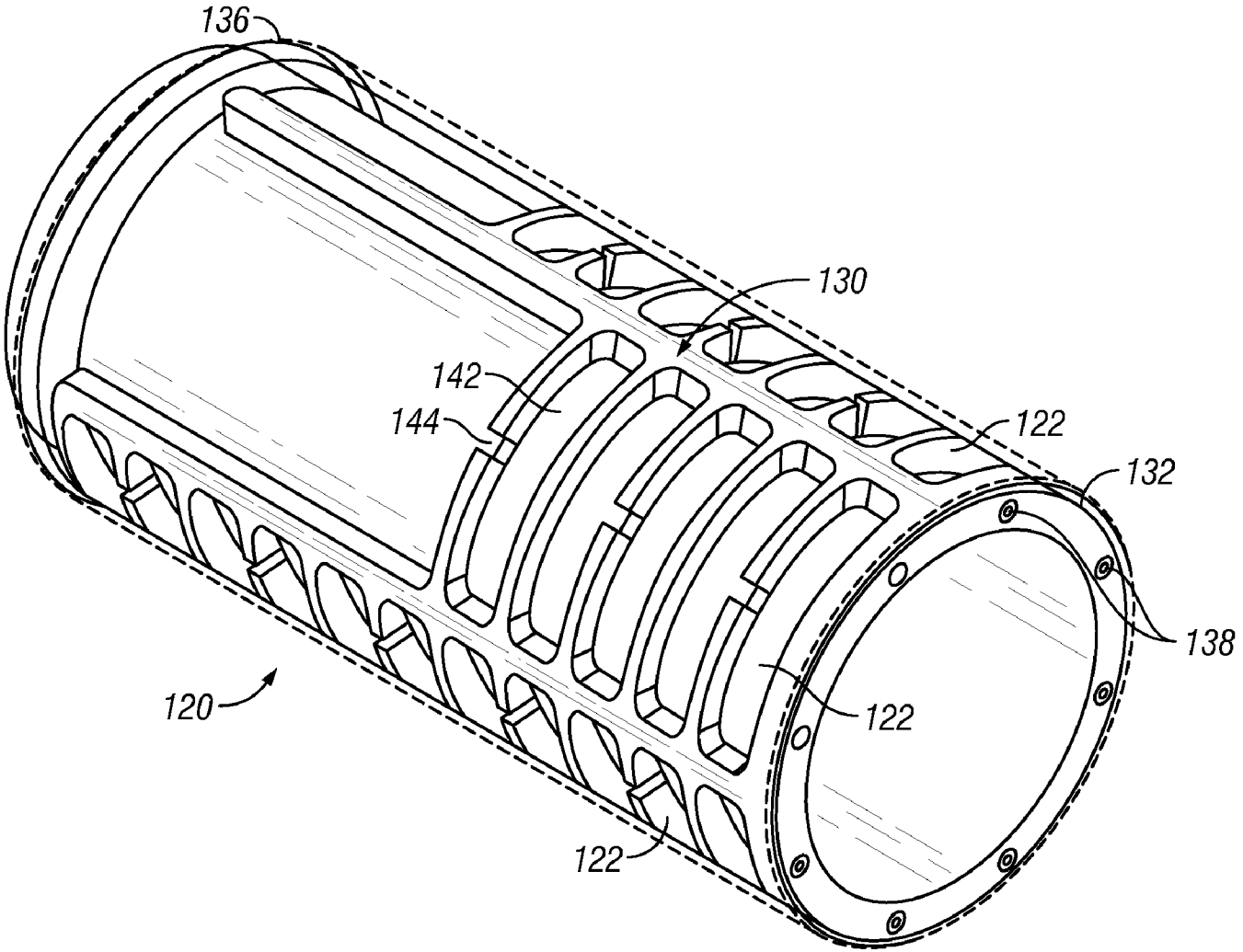
FIG. 4 is an isometric view of a flow control device made in accordance with one embodiment of the present disclosure.

Referring now to FIG. 4, there are shown further details of the flow control device 120 that creates a pressure drop by conveying the in-flowing fluid through one or more conduits 122 of a plurality of conduits 122. Each conduit 122 may be formed along a wall of a base tubular or mandrel 130 and include structural features configured to control flow in a predetermined manner. While not required, the conduits 122 may be aligned in a parallel fashion and longitudinally along the long axis of the mandrel 130. Each conduit 122 may have one end 132 in fluid communication with the wellbore tubular flow bore 102 (FIG. 3) and a second end 134 that is in fluid communication with the annular space or annulus 30 (FIG. 3) separating the flow control device 120 and the formation. Generally, each conduit 122 is separated from one another, at least in the region between their respective ends 132, 134. An outer housing 136, shown in hidden lines, encloses the mandrel 130 such that the conduits 122 are the only paths for fluid flow across the mandrel 130. In embodiments, along the mandrel 130, at least two of the conduits 122 provide independent flow paths between the annulus and the tubular flow bore 102 (FIG. 3). One or more of the conduits 122 may be configured to receive an occlusion member that either partially or completely restricts flow across that conduit 122. In one arrangement, the occlusion member may be a plug 138 that is received at the second end 134. For instance, the plug 138 may be threaded or chemically affixed to the first end 132. In other embodiments, the closure element may be affixed to the second end 134. In still other embodiments, the closure element may be positioned anywhere along the length of a conduit 122.

In embodiments, the conduits 122 may be arranged as a labyrinth that forms a tortuous or circuitous flow path for the fluid flowing through the flow control device 120. In one embodiment, the conduits 122 may include a series of chambers 142 that are interconnected by openings 144. During one exemplary use, a fluid may initially flow into the conduit 122 and be received into a chamber 142. Then, the fluid flows through the opening 144 and into another chamber 142. The flow through the opening 144 may generate a pressure drop greater than the flow across the chamber 142. The openings 144 may be formed as orifices, slots any other features that provides fluid communication between the chambers 144. The fluid flows along this labyrinth-like flow path until the fluid exits via either the end 132 or the end 134.

Figure 5:
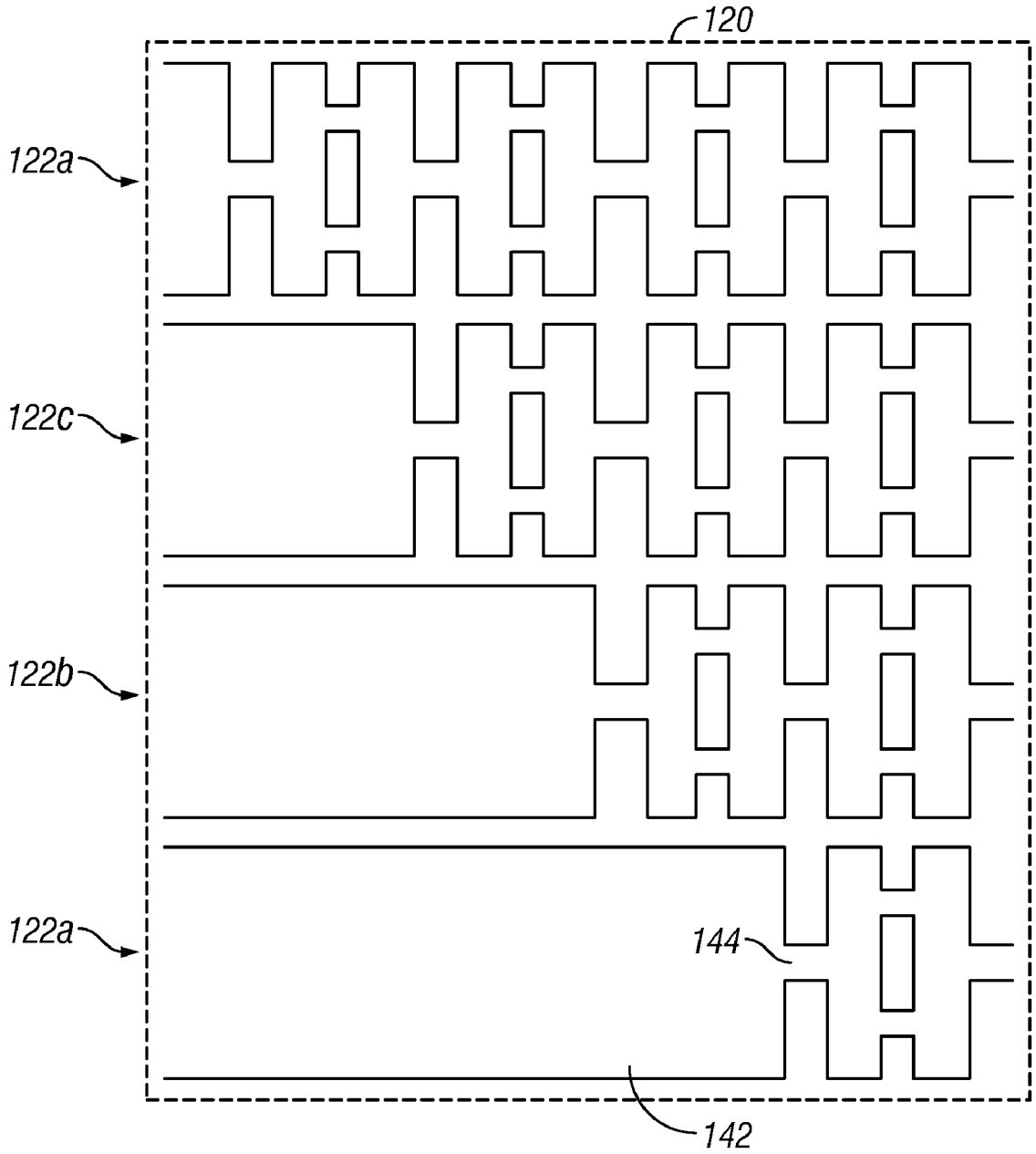
FIG. 5 is a functional view of an "unwrapped" flow control device made in accordance with one embodiment of the present disclosure.

For ease of explanation, FIG. 5 functionally shows the fluid flow paths for four illustrative conduits 122*a*, 122*b*, 122*c*, and 122*d* of the flow control device 120. For ease of explanation, the flow control device 120 is shown in phantom lines and "unwrapped" in order to better depict the conduits 122*a-d*. Each of these conduits 122*a*, 122*b*, 122*c*, and 122*d* provides a separate and independent flow path between the annulus 30 (FIG. 3) or formation and the tubular flow bore 102. Also, in the embodiment shown, each of the conduits 122*a*, 122*b*, 122*c*, and 122*d* provides a different pressure drop for a flowing fluid. The conduit 122*a* is constructed to provide the least amount of resistance to fluid flow and thus provides a relatively small pressure drop. The conduit 122*d* is constructed to provide the greatest resistance to fluid flow and thus provides a relatively large pressure drop. The conduits 122*b,c* provide pressure drops in a range between those provided by the conduits 122*a,d*. It should be understood, however, that in other embodiments, two or more of the conduits may provide the same pressure drops or that all of the conduits may provide the same pressure drop.

Referring now to FIGS. 4 and 5, as noted previously, the occlusion member 138 may be positioned along one or more of the conduits 122*a-d* to block fluid flow. In some embodiments, the occlusion member 138 may be positioned at the end 132 as shown. For instance, the occlusion member 138 may be a threaded plug or other similar element. In other embodiments, the occlusion member 138 may also be positioned at the end 134. In still other embodiments, the occlusion member 138 may be a material that fills the chambers or openings along the conduits 122*a-d*. The occlusion member 138 may be configured to either partially or completely block flow in the conduits 122*a-d*. Thus, the fluid flow across the flow control device 120 may be adjusted by selectively occluding one or more of the conduits 122. The number of permutations for available pressure drops, of course, vary with the number of conduits 122. Thus, in embodiments, the flow control device 120 may provide a pressure drop associated with the flow across one conduit, or a composite pressure drop associated with the flow across two or more conduits.

Thus, in embodiments, the flow control device may be constructed to be tuned or configured "in the field" to provide a selected pressure drop. For example, leaving all conduits 122*a-d* unobstructed would maximize the number of flow conduits and provide the lowest pressure drops. To increase the pressure drop, an occlusion member 138 may be fitted into a conduit 122 to block fluid flow. Thus, in arrangements, selectively occluding the conduits 122 by using the occlusion member 138 may be used to control the pressure differential generated by the flow control device. It should therefore be appreciated that a flow control device can be configured or re-configured at a well site to provide the pressure differential and back pressure to achieve the desired flow and drainage characteristics for a given reservoir and/or the desired injection flow characteristics.

Additionally, in embodiments, some or all of the surfaces of the conduits 122 may be constructed to have a specified frictional resistance to flow. In some embodiments, the friction may be increased using textures, roughened surfaces, or other such surface features. Alternatively, friction may be reduced by using polished or smoothed surfaces. In embodiments, the surfaces may be coated with a material that increases or decreases surface friction. Moreover, the coating may be configured to vary the friction based on the nature of the flowing material (e.g., water or oil). For example, the surface may be coated with a hydrophilic material that absorbs water to increase frictional resistance to water flow or a hydrophobic material that repels water to decrease frictional resistance to water flow.

Referring generally to FIGS. 1-5, in one mode of deployment, the reservoirs 14 and 16 may be characterized via suitable testing to estimate a desirable drainage pattern or patterns. The desired pattern(s) may be obtained by suitably adjusting the flow control devices 140 to generate a specified pressure drop. The pressure drop may be the same or different for each of the flow control devices 140 positioned along the tubular 22. Prior to insertion into the wellbore 10, formation evaluation information, such as formation pressure, temperature, fluid composition, wellbore geometry and the like, may be used to estimate a desired pressure drop for each flow control device 140. Thereafter, the conduits 122 for each flow control device 140 may be blocked as needed to obtain the desired pressure drop. Thus, for instance, referring now to FIG. 5, for a first flow control device, only the conduit 122*a* may be occluded, for a second flow control device 140, only conduits 122*b* and 122*c* may be occluded, for a third flow control device 140, none of the conduits 122*a-d* may be occluded, etc. Once configured to provide the desired pressure drop, the wellbore tubular 22 along with the inflow control devices 140 may be conveyed into and installed in the well.

During one mode of operation, fluid from the formation flows through the particulate control device 110 and then into the flow control device 140. As the fluid flows through the conduits 122, a pressure drop is generated that results in a reduction of the flow velocity of the fluid. In another mode of operation, fluid is pumped through the wellbore tubular 22 and across the flow control device 140. As the fluid flows through the conduits 122, a pressure drop is generated that results in a reduction of the flow velocity of the fluid flowing through the particulate control device 110 and into the annulus 30 (FIG. 3).

It should be understood that FIGS. 1 and 2 are intended to be merely illustrative of the production systems in which the teachings of the present disclosure may be applied. For example, in certain production systems, the wellbores 10, 11 may utilize only a casing or liner to convey production fluids to the surface. The teachings of the present disclosure may be applied to control the flow into those and other wellbore tubulars.

It should be further appreciated that the conduits that may also include a permeable medium. The permeability of the conduit may be controlled by appropriate selection of the structure of the permeable medium. Generally speaking, the amount of surface area along the conduit, the cross-sectional flow area of the conduit, the tortuosity of conduit the, among other factors, determine the permeability of the conduit. In one embodiment, the permeable medium may be formed using elements that are packed into the conduit. The elements may be granular elements such as packed ball bearings, beads, or pellets, or fiberous elements such as "steel wool" or any other such element that form interstetial spaces through which a fluid may flow. The elements may also be capillary tubes arranged to permit flow across the conduit. In other embodiments, the permeable medium may include one or more bodies in which pores are formed. For example, the body may be a sponge-like object or a stack of filter-type elements that are perforated. It will be appreciated that appropriate selection of the dimensions of objects such as beads, the number, shape and size of pores or perforations, the diameter and number of capillary tubes, etc., may yield the desired permeability for a selected pressure drop. Thus, such elements may used instead of or in addition to the chambers described above.

It should be appreciated that what has been described includes, in part, an apparatus for controlling a flow of a fluid between a wellbore tubular and a formation. The apparatus may include a body having two or more flow paths for conveying the fluid. The flow paths may be hydraulically isolated from one another in the body, and at least one of the flow paths may be occludable. In some arrangements, each of the flow paths generates a different pressure drop in the fluid flowing there across. In certain embodiments, at least one of the flow paths includes a chamber and at least one opening communicating with the chamber. Other embodiments may include more than one chamber and openings. For instance, a flow path may include a plurality of chambers, each of the chambers being in fluid communication with one another. In arrangements, each of the several flow paths includes a plurality of chambers and each of the chambers may be in fluid communication with one another. Each of the flow paths may generate a different pressure drop there across. In certain embodiments, each of the flow paths has a first end in communication with an annulus of the wellbore and a second end in communication with a bore of the wellbore tubular. Also, in arrangements, an occlusion member may occlude one or more of the flow paths.

It should be appreciated that what has been described includes, in part, a method for controlling a flow of a fluid between a wellbore tubular and an annulus of the well. The method may include forming at least two flow paths in a body, each of the flow paths having a first end in communication with the annulus and a second end in communication with a bore of the wellbore tubular; forming at least one of the at least two flow paths to receive an occlusion member; and hydraulically isolating the at least two flow paths from one another in the body. The method may further include occluding at least one of the flow paths with the occlusion member. In embodiments, the method may also include configuring each of the flow paths to generate a different pressure drop in the fluid flowing there across. Also, the method may include configuring at least one of the flow paths to include a chamber and at least one opening communicating with the chamber. Further, the method may include configuring at least one of the flow paths to include a plurality of chambers, each of the chambers being in fluid communication with one another. Still further, the method may include configuring each of the at least two flow paths to include a plurality of chambers, each of the chambers being in fluid communication with one another, and wherein each of the at least two flow paths generates a different pressure drop there across. Also, the method may include providing each of the at least two flow paths with a first end in communication with an annulus of the wellbore and a second end in communication with a bore of the wellbore tubular.

It should be appreciated that what has been described includes, in part, a system for controlling a flow of fluid in a well. The system may include a wellbore tubular disposed in the well, the wellbore tubular having a flow bore and; a plurality of flow control devices positioned along the wellbore tubular. Each of the flow control devices may include a body having a plurality of flow paths configured to convey the fluid between an annulus of the well and the flow bore, each of the flow paths having a first end in communication with an annulus of a wellbore and a second end in communication with the flow bore and each of the flow paths being hydraulically isolated from one another between their respective first ends and second ends, and wherein at least one of the plurality of flow paths is selectively closable.

For the sake of clarity and brevity, descriptions of most threaded connections between tubular elements, elastomeric seals, such as o-rings, and other well-understood techniques are omitted in the above description. Further, terms such as "valve" are used in their broadest meaning and are not limited to any particular type or configuration. The foregoing description is directed to particular embodiments of the present disclosure for the purpose of illustration and explanation. It will be apparent, however, to one skilled in the art that many modifications and changes to the embodiment set forth above are possible without departing from the scope of the disclosure.

What is claimed is:

1. An apparatus for controlling a flow of a fluid between a wellbore tubular and a formation, comprising:

a body having at least two flow paths configured to convey the fluid, the at least two flow paths being hydraulically isolated from one another in the body, wherein at least one of the at least two flow paths is configured to be selectively occludable, and wherein at least one of the at least two flow paths includes a plurality of chambers, each of the chambers being in fluid communication with one another.

2. The apparatus according to claim 1 wherein each of the at least two flow paths is configured to generate a different pressure drop in the fluid flowing thereacross.

3. The apparatus according to claim 1 wherein at least one of the at least two flow paths includes at least one chamber and at least one opening communicating with the at least one chamber.

4. The apparatus according to claim 1, wherein each of the at least two flow paths includes a plurality of chambers, and wherein each of the at least two flow paths generates a different pressure drop there across.

5. The apparatus according to claim 1 wherein each of the at least two flow paths has a first end in communication with an annulus of the wellbore and a second end in communication with a bore of the wellbore tubular.

6. The apparatus according to claim 1 further comprising an occlusion member configured to occlude the at least one of the at least two flow paths.

7. A method for controlling a flow of a fluid between a wellbore tubular and an annulus of the well, comprising:

forming at least two flow paths in a body, each of the flow paths having a first end in communication with the annulus and a second end in communication with a bore of the wellbore tubular;

forming at least one of the at least two flow paths to receive an occlusion member;

configuring at least one of the at least two flow paths to include a plurality of chambers, each of the chambers being in fluid communication with one another; and hydraulically isolating the at least two flow paths from one another in the body.

8. The method according to claim 7 further comprising occluding at least one of the at least two flow paths with the occlusion member.

9. The method according to claim 7 further comprising configuring each of the at least two flow paths to generate a different pressure drop in the fluid flowing thereacross.

10. The method according to claim 7 further comprising configuring at least one of the at least two flow paths to include at least one chamber and at least one opening communicating with the at least one chamber.

11. The method according to claim 7, wherein each of the at least two flow paths includes a plurality of chambers, and wherein each of the at least two flow paths generates a different pressure drop there across.

12. The method according to claim 7 further comprising providing each of the at least two flow paths with a first end in communication with an annulus of the wellbore and a second end in communication with a bore of the wellbore tubular.

13. A system for controlling a flow of fluid in a well, comprising:

a wellbore tubular disposed in the well, the wellbore tubular having a flow bore;

a plurality of flow control devices positioned along the wellbore tubular, each of the flow control devices including:

a body having a plurality of flow paths configured to convey the fluid between an annulus of the well and the flow bore, each of the flow paths having a first end in communication with an annulus of a wellbore and a second end in communication with the flow bore and each of the flow paths being hydraulically isolated from one another between their respective first ends and second ends, wherein each of the at least two flow paths includes a plurality of chambers, each of the chambers being in fluid communication with one another, and wherein each of the at least two flow paths generates a different pressure drop there across, and wherein at least one of the plurality of flow paths is selectively closable.

14. The system according to claim 13 wherein each the plurality of flow paths is configured to generate a different pressure drop in the fluid flowing thereacross.

15. The system according to claim 13 further comprising an occlusion member configured to close the at least one of the plurality of flow paths.

16. The apparatus according to claim 13 wherein each of the at least two flow paths is configured to generate a different pressure drop in the fluid flowing thereacross.

17. The apparatus according to claim 13 wherein at least one of the at least two flow paths includes at least one chamber and at least one opening communicating with the at least one chamber.

* * * * *